US007577383B2

(12) United States Patent
Brown et al.

(10) Patent No.: US 7,577,383 B2
(45) Date of Patent: Aug. 18, 2009

(54) APPARATUS AND METHOD FOR TRANSPORTING POWDER TO AN IMAGE DEVICE OF AN ELECTROSTATOGRAPHIC PRINTER

(75) Inventors: Kenneth J. Brown, Penfield, NY (US); David S. Kepner, Bloomfield, NY (US)

(73) Assignee: Eastman Kodak Company, Rochester, NY (US)

( * ) Notice: Subject to any disclaimer, the term of this patent is extended or adjusted under 35 U.S.C. 154(b) by 46 days.

(21) Appl. No.: 11/680,166

(22) Filed: Feb. 28, 2007

(65) Prior Publication Data

US 2008/0205936 A1 Aug. 28, 2008

(51) Int. Cl.
*G03G 15/08* (2006.01)

(52) U.S. Cl. ..... 399/256; 399/254

(58) Field of Classification Search ..... 399/254, 399/255, 256

See application file for complete search history.

(56) References Cited

U.S. PATENT DOCUMENTS 5,025,287 A * 6/1991 Hilbert ..... 399/254
5,260,159 A 11/1993 Ohtani et al.
5,570,170 A 10/1996 Muranyi et al.
5,655,193 A * 8/1997 Fujishiro et al. ..... 399/256
6,421,516 B1 * 7/2002 Kinoshita et al. ..... 399/254
6,480,689 B2 * 11/2002 Jacobs ..... 399/256
7,228,093 B2 * 6/2007 Sakai et al. ..... 399/254

* cited by examiner

*Primary Examiner*—Sandra L Brase
(74) *Attorney, Agent, or Firm*—Donna P. Suchy

(57) ABSTRACT

An apparatus and method for dispensing toner in an electrostatographic printer includes an apparatus for transporting powder into a developer station containing at least powder and magnetic carrier including a conveyance housing divided into a mixing space adjacent to a second separate transport space, the second transport space located adjacent to a development roller, a powder conveying device located in the conveyance housing comprising two or more augers and a conveyance controller for controlling the powder conveying device, including the one or more augers, such that the auger preferentially mixes in the first mixing space and transports in the second transport space as the powder conveying device conveys the powder toward the imaging device of a print engine.

29 Claims, 12 Drawing Sheets

CONFIGURATION A
*(CCW ROTATION):*
*PUSH % - 36%*
*FLIP % - 61%*

CONFIGURATION A
*(CW ROTATION):*
*PUSH % - ≈0%*
*FLIP % - 95%*

APPARATUS AND METHOD FOR TRANSPORTING POWDER TO AN IMAGE DEVICE OF AN ELECTROSTATOGRAPHIC PRINTER

FIELD OF THE INVENTION

The invention relates to electrographic printers and apparatus thereof. More specifically, the invention is directed to an apparatus and method for transporting a powder, such as developer to an image device in an electrostatographic printer.

BACKGROUND OF THE INVENTION

Electrographic printers and copiers utilizing developer comprising toner, carrier, and other components use a developer mixing apparatus and related processes for mixing the developer and toner used during the printing process. The term "electrographic printer," is intended to encompass electrophotographic printers and copiers that employ dry toner developed on an electrophotographic receiver element, as well as ionographic printers and copiers that do not rely upon an electrophotographic receiver. The electrographic apparatus often incorporates an electromagnetic brush station or similar development station, to develop the toner to a substrate (an imaging/photoconductive member bearing a latent image), after which the applied toner is transferred onto a sheet and fused thereon.

As is well known, a toner image may be formed on a photoconductor by the sequential steps of uniformly charging the photoconductor surface in a charging station using a corona charger, exposing the charged photoconductor to a pattern of light in an exposure station to form a latent electrostatic image, and toning the latent electrostatic image in a developer station to form a toner image on the photoconductor surface. The toner image may then be transferred in a transfer station directly to a receiver, e.g., a paper sheet, or it may first be transferred to an intermediate transfer member or ITM and subsequently transferred to the receiver. The toned receiver is then moved to a fusing station where the toner image is fused to the receiver by heat and/or pressure.

In electrostatographic copiers and printers, pigmented thermoplastic particles, commonly known as "toner," are applied to latent electrostatic images to render such images visible. Often, the toner particles are mixed with and carried by somewhat larger particles of magnetic material. During the mixing process, the magnetic carrier particles serve to triboelectrically charge the toner particles to a polarity opposite that of the latent charge image. In use, the development mix is advanced, typically by magnetic forces, from a sump to a position in which it contacts the latent charge image. The relatively strong electrostatic forces associated with the charge image operate to strip the toner from the carrier, causing the toner to remain with the charge image. Thus, it will be appreciated that, as multiple charge images are developed in this manner, toner particles are continuously depleted from the mix and a fresh supply of toner must be dispensed from time-to-time in order to maintain a desired image density. Usually, the fresh toner is supplied from a toner supply bottle mounted upside-down, i.e., with its mouth facing downward, at one end of the image-development apparatus. Under the force of gravity, toner accumulates at the bottle mouth, and a metering device, positioned adjacent the bottle mouth, operates to meter sufficient toner to the developer mix to compensate for the toner lost as a result of image development. Usually, the toner-metering device operates under the control of a toner concentration monitor that continuously senses the ratio of toner to carrier particles in the development mix.

It is well known that toner is a powdery substance that exhibits a considerable degree of cohesiveness and, hence, relatively poor flowability. Since the force of gravity alone does not usually suffice in causing toner to flow smoothly from the mouth of an inverted toner bottle, other supplemental techniques have been used to "coax" the toner from the bottle. For example, flow additives, such as silica and the like, have been added to the mix to reduce the troublesome cohesive forces between toner particles. See, e.g., the disclosure of U.S. Pat. No. 5,260,159 in which a "fluidization" agent is added to a developer mix in a development sump to assist the movement of developer therein. While beneficial to a more consistent flow of developer, such substances influence other performance attributes of the development process and their effectiveness is therefore constrained. Automatically operated stirring devices or augers mounted within a horizontally oriented toner container, and thumping or vibrating devices connected to such containers have also been used to urge toner from its rest position towards an outlet or exit port. Such mechanical techniques work well when the toner container is relatively small (e.g., 2 to 5 liters) and the height of the toner column above the exit port is relatively low (e.g., lower than about 15 cm.) so as to avoid gravity-assisted compaction of the toner which further compromises flowability. But, as the size of the toner bottle or container increases, e.g., to accommodate high speed and wide format printing in which toner is consumed at extraordinarily fast rates, the above-noted flow-enhancing techniques have been found to be inadequate. In such high toner-consumption situations, toner sumps of the order of tens of liters are desirable in order to eliminate the need for frequent toner bottle replacements. The weight of the toner in these large volume containers is too great for conventional rappers and vibrators to keep the toner flowing through the outlet, and most of these devices only exacerbate the toner-packing problem.

In U.S. Pat. No. 5,570,170, there is disclosed an apparatus for dispensing single-component, electrically conductive magnetic toner particles from a pair of inverted toner bottles mounted above a conventional development station in an electrostatic printing apparatus. A screen positioned at the mouth of each bottle serves to prevent toner flow from the bottle whenever the toner is piled up atop the screen. The toner-dispensing apparatus includes a pair of gas-permeable, but toner-impermeable, tubes that extend upwardly, into each bottle, a distance of about 30-60% of the height of the bottles. On command, pressurized gas is introduced into the tubes. As the gas passes through the tubes and into the toner bottles, it acts to fluidize the toner in the bottle in the vicinity of the bottle's outlet, thereby enabling the toner to flow smoothly through the screen mesh and into the development station of the printer, as needed. In effect, the screen acts as a gate to prevent toner flow into the development station until the toner above the screen is fluidized. A microprocessor controls the application of pressurized gas to each of the bottles, switching from one bottle to the other as one-bottle empties. By using two bottles, the machine operator can replace an empty bottle without shutting down the machine.

Development stations require replenishment of toner into the developer sump to replace toner that is deposited on the photoconductor or receiver. In development stations utilizing carrier, this toner must be mixed uniformly with the carrier. Replenishment has been done at a single location in the developer sump but this has lead to high concentrations of low-charge toner in one area of the sump, which tends to produce a dark streak on the image or receiver, or produces non-uniform areas in an image.

The present invention corrects the problem of non-uniform mixing. The apparatus and related methods transport and mix the toner efficiently when needed, maintaining the correct proportions necessary to produce the high quality prints or powder coatings required by consumer demand. The following invention solves the current problems with developer mixing so that the mixer will work in a wide variety of situations and with different types of toners, powders, or particles.

SUMMARY OF THE INVENTION

The invention is in the field of mixing apparatus and processes for electrographic printers and powder coating systems. More specifically, the invention relates to an apparatus and method for distributed mixing and transport of toner and powders, including toner in powder form as well as powder coatings and similar materials. The apparatus for transporting powder into a developer station containing at least powder and magnetic carrier including a conveyance housing divided into a mixing space adjacent to a second separate transport space, the second transport space located adjacent to a development roller, a powder conveying device located in the conveyance housing comprising two or more augers and a conveyance controller for controlling the powder conveying device, including the one or more augers, such that the auger preferentially mixes in the first mixing space and transports in the second transport space as the powder conveying device conveys the powder toward the imaging device of a print engine.

DETAILED DESCRIPTION OF THE INVENTION

Figure 1:
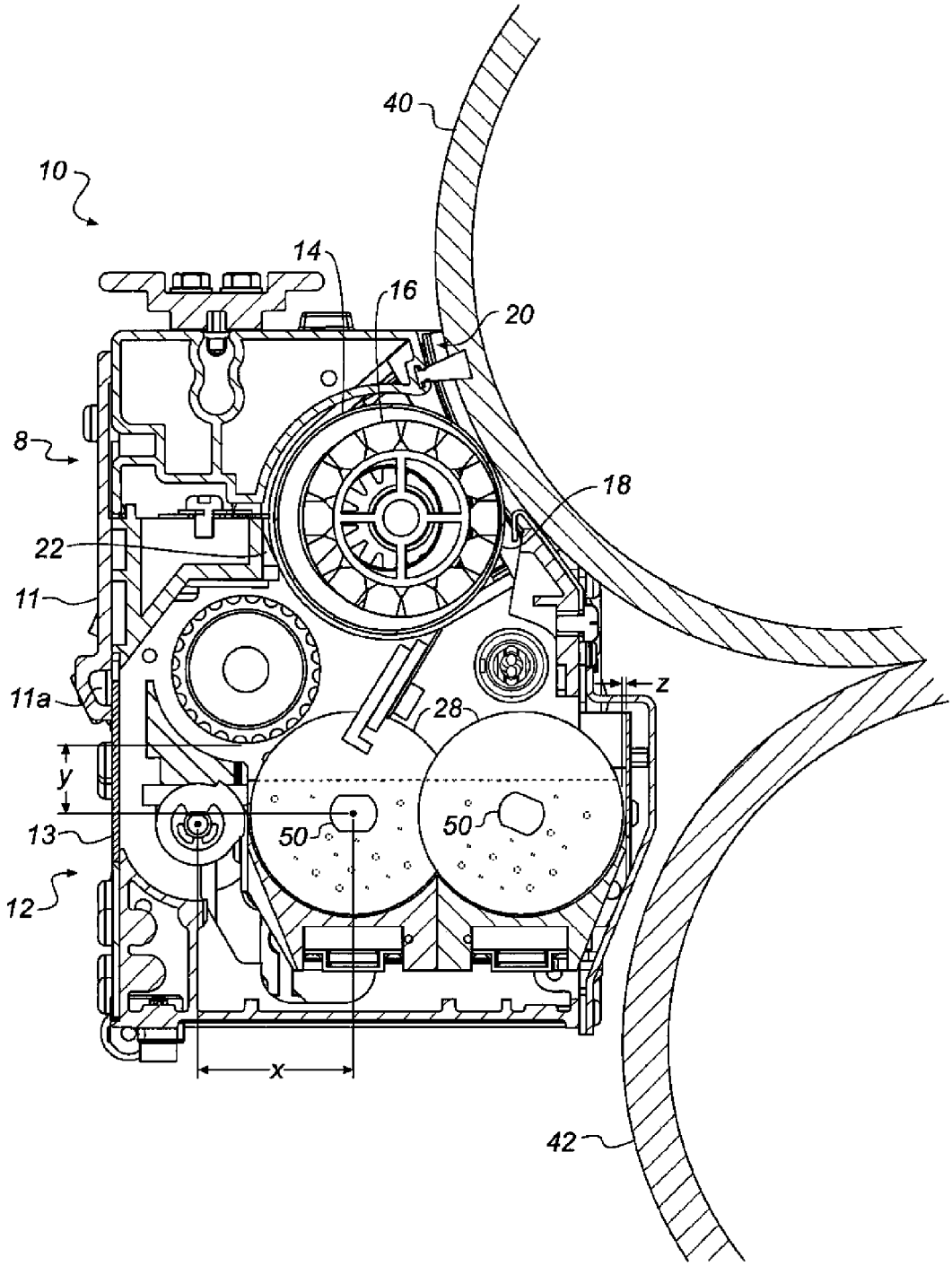
FIG. 1 is a side elevational view, in cross-section, of a reproduction apparatus magnetic brush developer station according to this invention.
Figure 3:
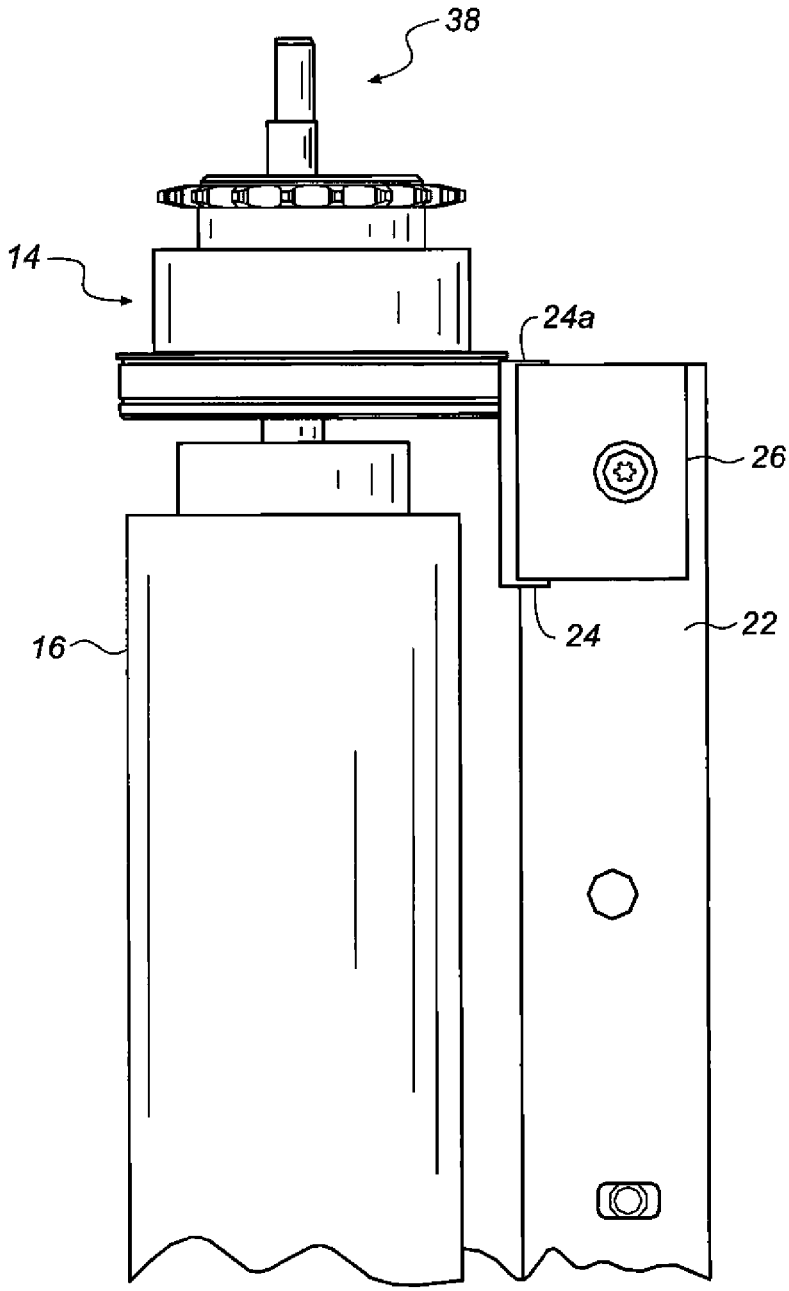
FIG. 3 is a bottom view, partly in cross-section and on an enlarged scale, of a portion of the development roller and metering skive of FIG. 2, particularly showing the magnetic seal according to this invention.

FIG. 1 shows a reproduction apparatus magnetic brush developer station, according to this invention, (also referred to as a developer station) designated generally by the numeral 10. The magnetic brush development station 10 includes a development station housing 11, divided into a feed apparatus 8 and a powder conveyance device 12. The powder conveyance device 12 is divided into a mixing space 44 adjacent to a transport space 46 (See FIG. 5). The housing forming, in part, a reservoir for developer material. A plurality of augers 28, having suitable mixing paddles, stir the developer material within the reservoir of the housing 11. The outside diameter of this auger typically spaced a distance Z from the inner wall of the housing. A development roller 14, mounted within the development station housing 11, includes a rotating (counter-clockwise in FIG. 1) fourteen-pole core magnet 16 inside a rotating (clockwise in FIG. 1) shell 18. Of course, the core magnet 16 and the shell can have any other suitable relative rotation. The quantity of developer material delivered from the reservoir portion of the housing 11 to the development zone 20 is controlled by a metering skive 22, positioned parallel to the longitudinal axis of the development roller 14, at a location upstream in the direction of shell rotation prior to the development zone. The metering skive 22 extends the length of the development roller 14 (see FIG. 3). The core magnet 16 does not extend the entire length of the development roller, as such, the developer nap on the shell 18 does not extend to the end of the development roller.

Figure 2:
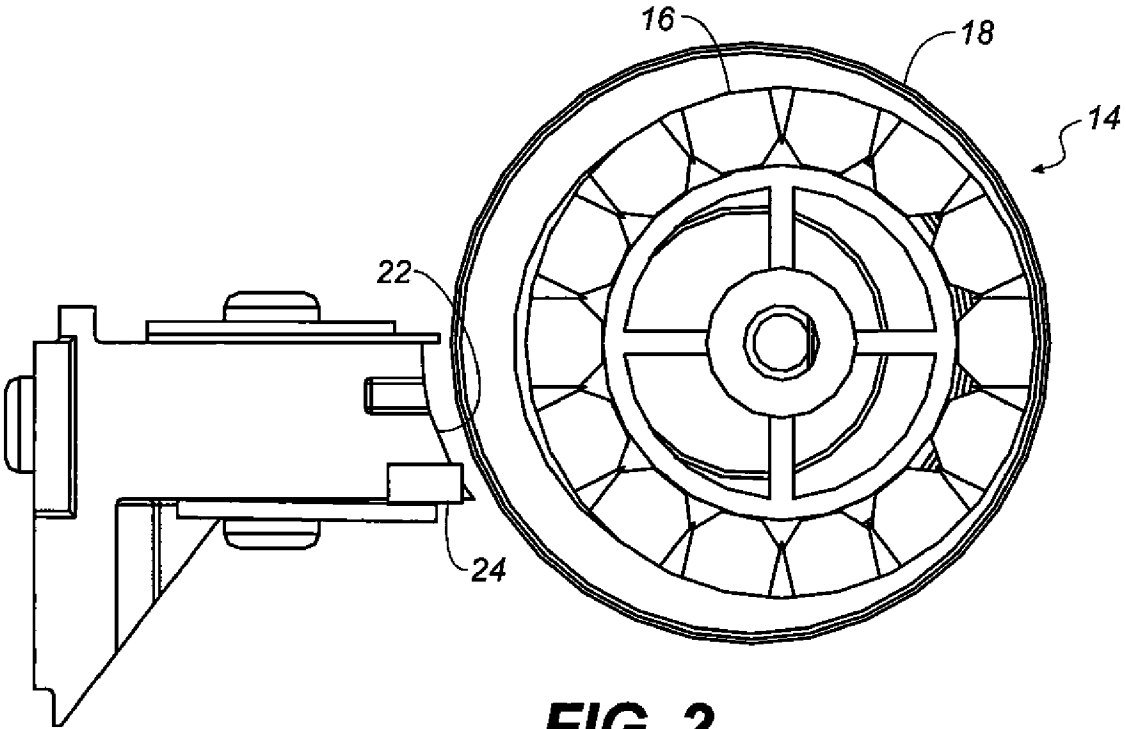
FIG. 2 is an end view, partly in cross-section and on an enlarged scale, of the development roller and metering skive of the magnetic brush development station of FIG. 1.

At each end of the development roller 14, a single pole permanent ceramic magnet 24 is used (one end shown in FIGS. 2 and 3) as a seal to prevent leakage of developer material from the ends of the development roller. The magnet 24 is selected to provide a magnetic field with a strength in the range of 400 to 1200 gauss, and preferably 900 gauss. One end 24*a* of the magnet 24 is approximately flush with the end of the development roller 14 and extends along the longitudinal axis of the development roller such that an overlap (approximately 10 mm) exists with the roller. The single pole magnet 24 is secured to the underside of the mount for the metering skive 22 by a metal plate and fastener 26 with the active pole of the magnet in close proximity to the developer roller circumference. The metal plate 26 functions to shunt the magnetic field except in the area of the magnet 24 which faces the developer roller 14.

It is apparent that the magnet 24 as described above provides an effective seal preventing developer material from escaping from the ends of the developer roller. Since this seal does not have any moving parts, there is no wear, and there is no mechanical friction which would generate heat and create undesirable developer material flakes. Moreover, there is no seal material which would wear and contaminate the developer material.

To further prevent development material from escaping from the development station housing 11, there is provided an easily serviced assembly for the driveshaft of the augers 28. A rotatable shaft 50 connected to each auger 28 to move the auger and thus help transporting developer material within the development station housing reservoir. One or more sealing members 48 including a lip seal formed of a material which is able to stretch sufficiently to maintain contact with shaft 50 while the shaft is being rotated by the drive member 38. This assembly is robust to wear and any heat generation. The two bearings with a spacer in between are used so as to maintain minimum radial movement of the shaft 50. The shaft includes a feature used for drive rotation and also a yoke to accept the end of the marking particles delivery auger. The shaft is hardened and ground to reduce wear and heat generation at the seal interface. The auger 28 is attached to the shaft 50 removeably with a pin or other attachment device that is captured in either side of the yoke of the shaft feature. The washer and e-rings complete the assembly and hold it together, and can be removed by disassembling any drive mechanism, and then removing the assembly.

The development station housing 11 has a membrane-type seal placed over a hole 11*a* in the side wall of the housing. The seal serves the purpose of providing pressure equalization within the housing. The surface area of the seal is selected to provide sufficient pressure equalization efficiency. The seal allows air flow, caused by pressure differential between inside the housing 11 and the exterior thereof, through the membrane without carrying developer material dust out of the housing. The seal is located in such a position as to cause developer material in the housing to continuously be moving across the membrane surface to continuously clean the membrane seal to maintain the efficient operation thereof.

Figure 4:
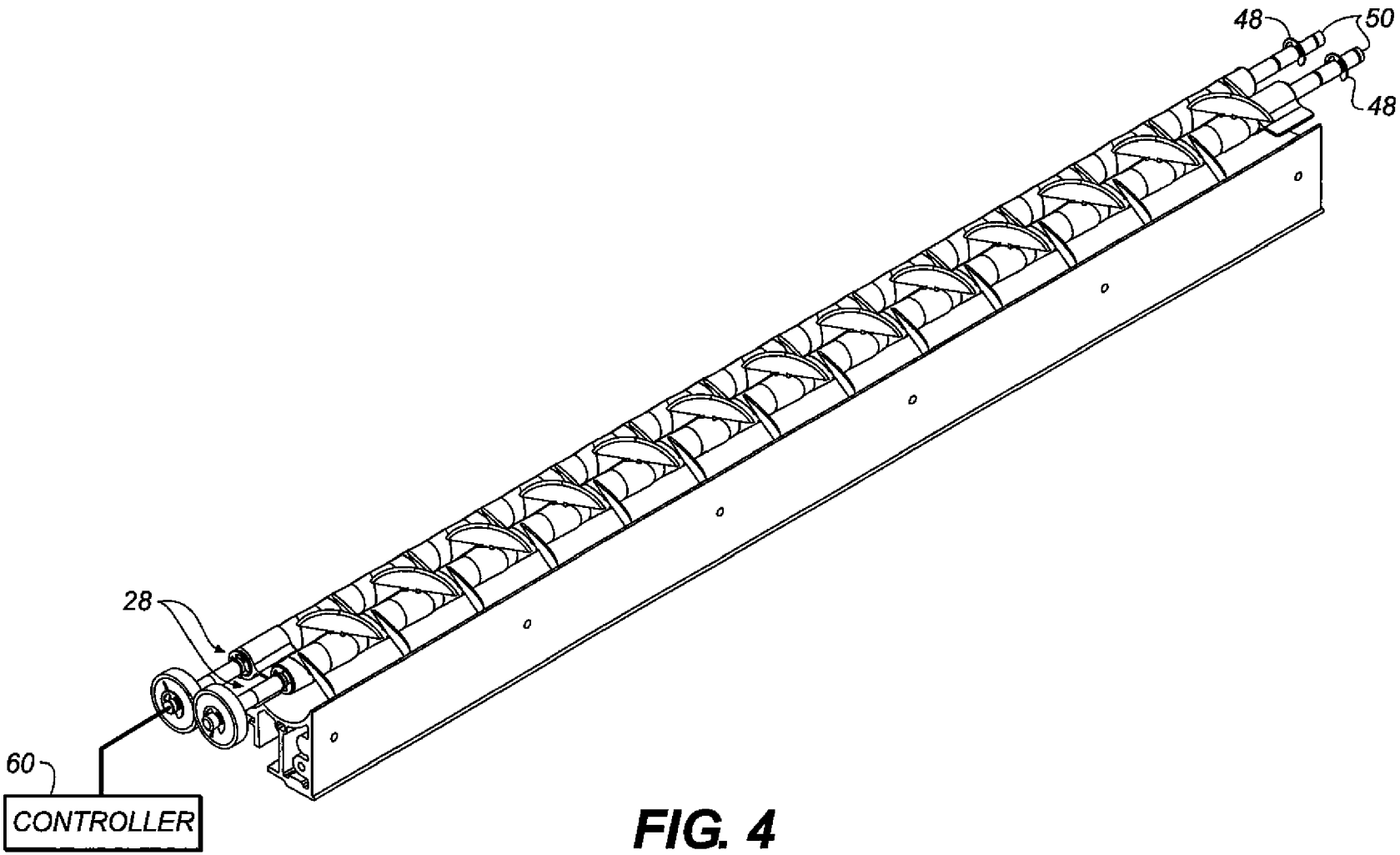
FIG. 4 is a view, in perspective, of the mixing augers of the magnetic brush development station of FIG. 1.

It should be noted that, as the reproduction apparatus market has evolved from black and white copiers to process color printers, more development stations needed to be fit into essentially the same amount of machine space. To do this a more compact station was needed that would still adequately mix developer material and hold as large a developer material volume as possible. The increased station capacity was desired to increase the time between developer material replenishment and changes. Also, the larger volume of developer material would allow for higher takeout rates of marking particles while removing a smaller percentage of the available particles. The solution has been to increase the development station housing reservoir "floor" space increase the nominal diameter of the augers. The magnetic brush development station 10, according to this invention, uses two augers 28 (see FIG. 1), although a different number could be used. The augers are controlled by controller 60 (See FIG. 4). The controller controls the powder conveying device, such that the auger preferentially mixes in the mixing space 44 and transports in the second transport space 46 as the powder is conveyed toward the feed apparatus 8. The increased reservoir capacity has two main advantages; it increases the time between developer changes, and allows for a longer dwell time of developer material in the reservoir for mixing (this improves material charging and material dispersion which aid in reducing dusting)

The magnetic brush development station 10, according to this invention, provides for replenishing the housing reservoir with a fresh supply of marking particles for the developer material as required, A single point system allows for greater total throughput of material while maintaining a minimal amount of fresh marking particles being added at any one point. This allows the marking particles to be mixed into the developer material much quicker and can subsequently get triboelectrically charged much quicker. This aids in reducing dusting and maintaining a uniform concentration of marking particles throughout the sump.

The developer station 10 must have a set spacing of the developer roller 14 to a photoconductor surface 40. There have been many attempts at different ways to control developer nap thickness on the developer roller 14 as a way to decrease the spacing sensitivity between the developer roller 14 and photoconductor 40. If the developer nap is too thick developer material can leak away from the ends of the magnetic core of the developer roller resulting in contamination of other areas of the electrophotographic reproduction apparatus, such as the photoconductor 40 and the intermediate transfer roller (blanket cylinder) 42. If the developer nap is too thin there may not be enough toner present to enable high quality development. To facilitate recharging of the developer material with new marking particles, the magnetic core 16 of the roller 14 is placed eccentrically inside the developer roller shell 18 allowing developer to fall off the shell when it reaches a region of lower magnetic field. This eliminates the need for a skive to remove developer from the roller and the toner flake and agglomerate generation that normally accompanies such design.

One embodiment of this invention is the orientation of the elements. The apparatus 10, according to this embodiment of the invention, has a plurality of auger shafts for the mixing of developer with fresh toner and the transport of the developer to the toning zone for image development. These augers consist of a shaft populated with blades (paddles), roughly semi-circular in shape, that are fixed at some angle with respect to the axial centerline of the shaft. It was suspected that the paddle properties could have a great influence on the movement and mixing efficiency of developer within the sump, and little historical data on the motivation for the current paddle setpoints were found. A series of experiments ensued to reveal the nature of paddle properties to both developer transport and mixing efficiency. This involved understanding the relationship between the relative amount of developer, including controlling the volume of powder to magnetic carrier volume, that is transported parallel to the axis of the auger shaft (Axial) vs. perpendicular to the axis of the auger shaft (Radial).

Figure 5:
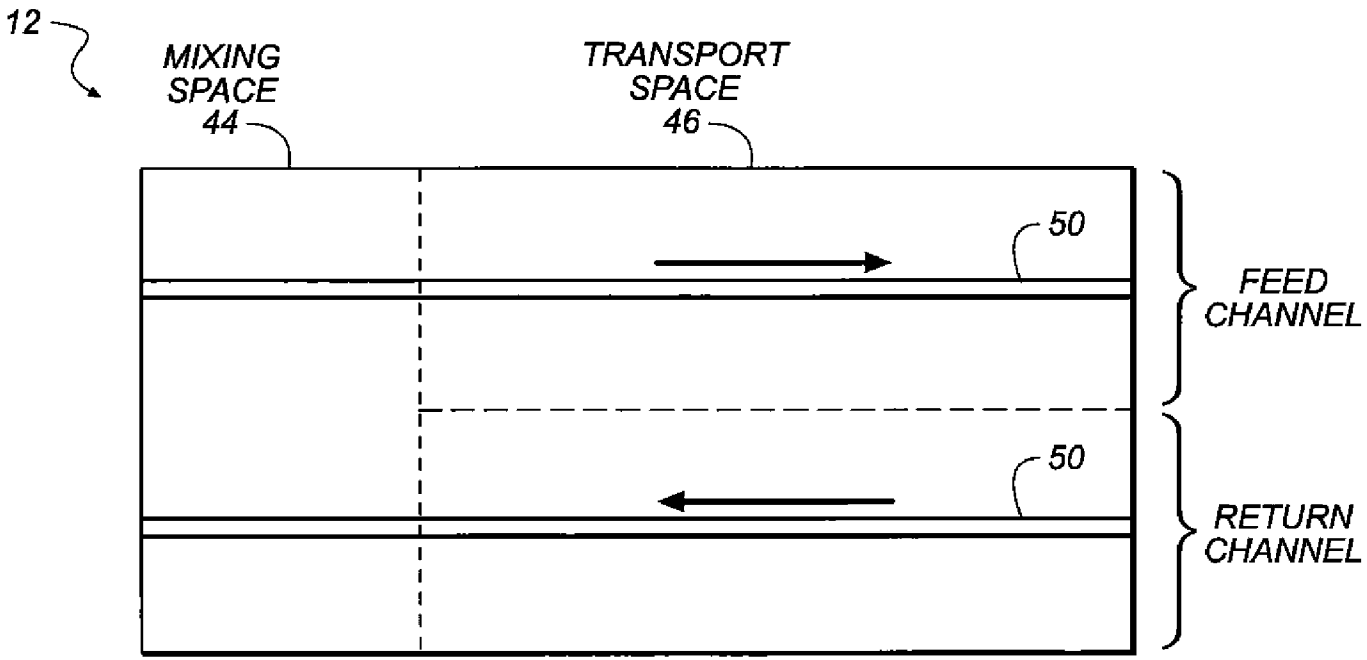
FIG. 5 is a schematic top view of FIG. 1.
Figure 6:
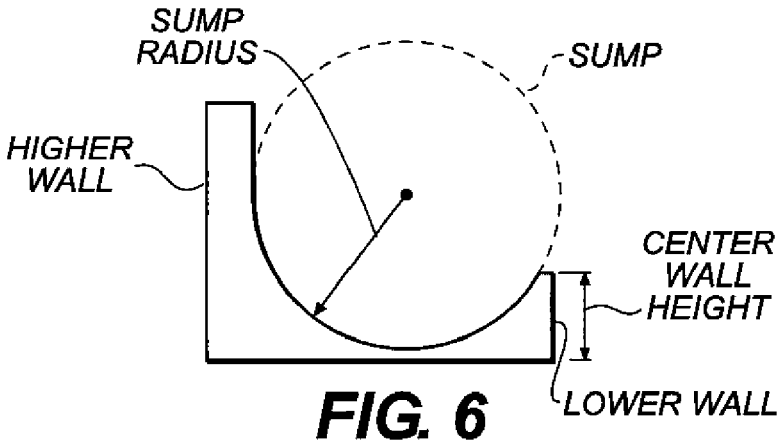
FIG. 6 is a schematic side view a single auger in a asymmetric sump.
Figure 7:
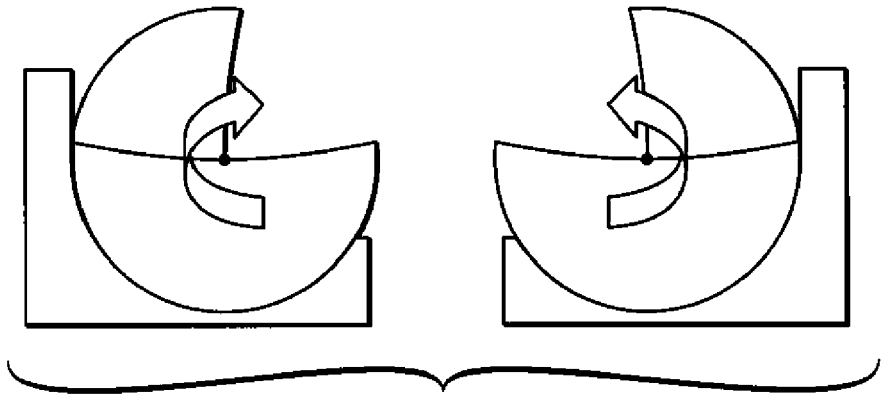
FIG. 7 is a schematic showing one embodiment of the present invention.

In the asymmetric sump (as defined by non equal heights of the opposing sidewalls) shown in FIG. 5, axial flow is maximized when the rotation of the auger is in the direction from the lower wall to the higher wall (see FIG. 5. The relationship between a series of factors influence the amount of developer that is pushed (axially to the shaft) and flipped (radially to the shaft) which effects the efficiency of the mixing and transportation of the powder. FIG. 7 shows a single channel example where the rotation sense of the auger relative to the sump is as shown. When the rotation of the auger relative to the sump changes the effectiveness of both mixing and transporting is effected as shown in FIG. 8.

Figure 8A:
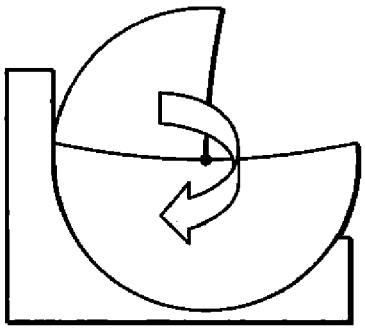
FIGS. 8*a* and 8*b* show a schematic of a single channel auger.
Figure 8B:
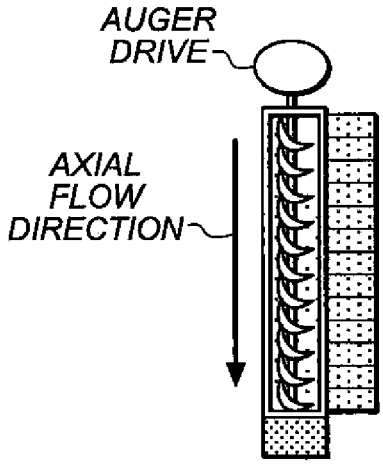

FIG. 8 is shows the auger configuration discussed above (equivalent sump size/orientation, center wall height, paddle angle, paddle pitch and auger speed), run against counterclockwise (CCW) and clockwise (CW) rotations. Clockwise rotation Push % (axial to shaft) and Flip % (radial to shaft) developer flow data were obtained from a visual observation of developer distributions after operation. The reason for this effect has to do the mechanism by which developer is moved axially along the wall of the sump. As the paddle rotates, the sidewall of the sump keeps the developer from moving radially under the action of the centrifugal force created by the rotation of the paddle. This then allows the developer to be moved axially along the sump, proportional to the angle the paddle to the auger shaft. Given this, a symmetrical sump, or one that has opposing walls of equal height, would not be sensitive to this effect. Thus, with an asymmetrical sump design, the rotation sense needs to be consistent with that described in the Summary of Invention section in order to establish an axial flow component in a dual auger sump.

Figure 9A:
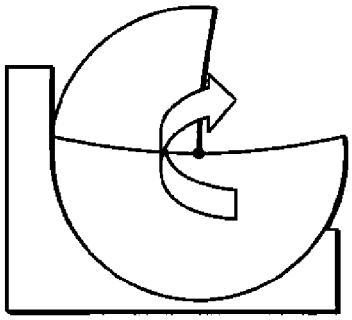
FIGS. 9*a* and 9*b* shows a schematic of auger rotation.
Figure 9B:
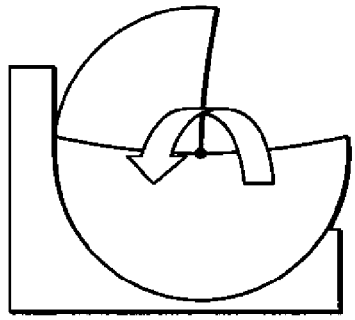
Figure 10:
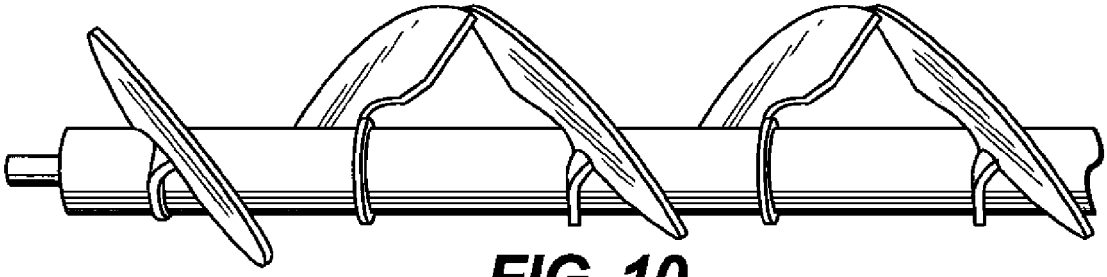
FIG. 10 is a schematic showing another embodiment of the present invention.

FIG. 9 shows one example of the auger shaft 50 for the mixing of developer with fresh toner and the transport of the developer to the toning zone for image development. These augers consist of a shaft populated with blades (paddles), roughly semi-circular in shape that when populated on the auger shaft has an equivalent conveyance housing diameter of 10 mm to 75 mm. The paddles are fixed at some angle (for example, 20 to 40 degrees) with respect to the axial centerline of the shaft. It was suspected that the paddle angle could have a great influence on the movement and mixing efficiency of developer within the sump, and little historical data on the motivation for the current paddle angle were found. A series of experiments ensued to reveal the nature of paddle angle to both developer transport and mixing efficiency. This involved understanding the relationship between the relative amounts of developer that is transported parallel to the axis of the auger shaft (Axial) vs. perpendicular to the axis of the auger shaft (Radial) based on a representative 90 angle paddle orientation as shown in FIG. 10.

The push to flip ratio (P/F) for a single channel auger can be optimized with the following relation:

$$P/F=-0.9582+0.085*\text{Sump Radius}-0.1309*X\text{-Over Ratio}-0.0057*\text{Blade Angle}+0.2832*\text{Blade Pitch}-0.0012*\text{Auger Speed}+0.0659*\text{Load Ratio},$$

where:

Sump Radius—Nominal radius of the auger sump, mm

X-Over Ratio—Sump Radius (mm)/Height of centerwall from sump tangent point (min)

Blade Angle—Angle of blade w.r.t. shaft drive axis (deg)

Blade Pitch—Axial Center to Center distance between blade pairs on the auger shaft (in)

Auger Speed—Speed of Auger Shaft (rpm)

Load Ratio−(π*(Sump Radius)^2)mm^2/150 gm, where 150 gm is a experimentally derived nominal single channel developer load Although this relationship holds specifically for an auger configuration where adjacent paddles (paddle pairs) are oriented 90° apart, adjacent paddle tips are in contact, and the auger is nominally spaced 0.5 to 1 mm from the inner wall of the housing, it can be modified or extended to cover other orientation angles and spacings. The relationship between a series of factors and how these factors influence the amount of developer that is pushed (Axially to the shaft) and flipped (radially to the shaft) was then developed. This experiment was structured as a 6 factor Central Composite Design (CCD), face centered, with 9 centerpoint replicates. The strategy was to characterize the flow with a single channel auger (see FIG. 7). The experimental factors for a single channel auger implementation are shown below (see Table 1 below):

TABLE 1

Factors for Single Channel Auger

| Factor | Low Level | Mid Level | High Level |
|---|---|---|---|
| Sump Radius | 17.4625 mm | 20.6375 mm | 25.4 mm |
| X-Over | 2.5 | 3.7 | 4.9 |
| Angle | 20° | 30° | 40° |
| Pitch | 0.3600 in | 0.5625 in | 0.7650 in |
| Speed | 106 rpm | 162 rpm | 218 rpm |
| Load Ratio | 5 | 6 | 7 |

Figure 12:
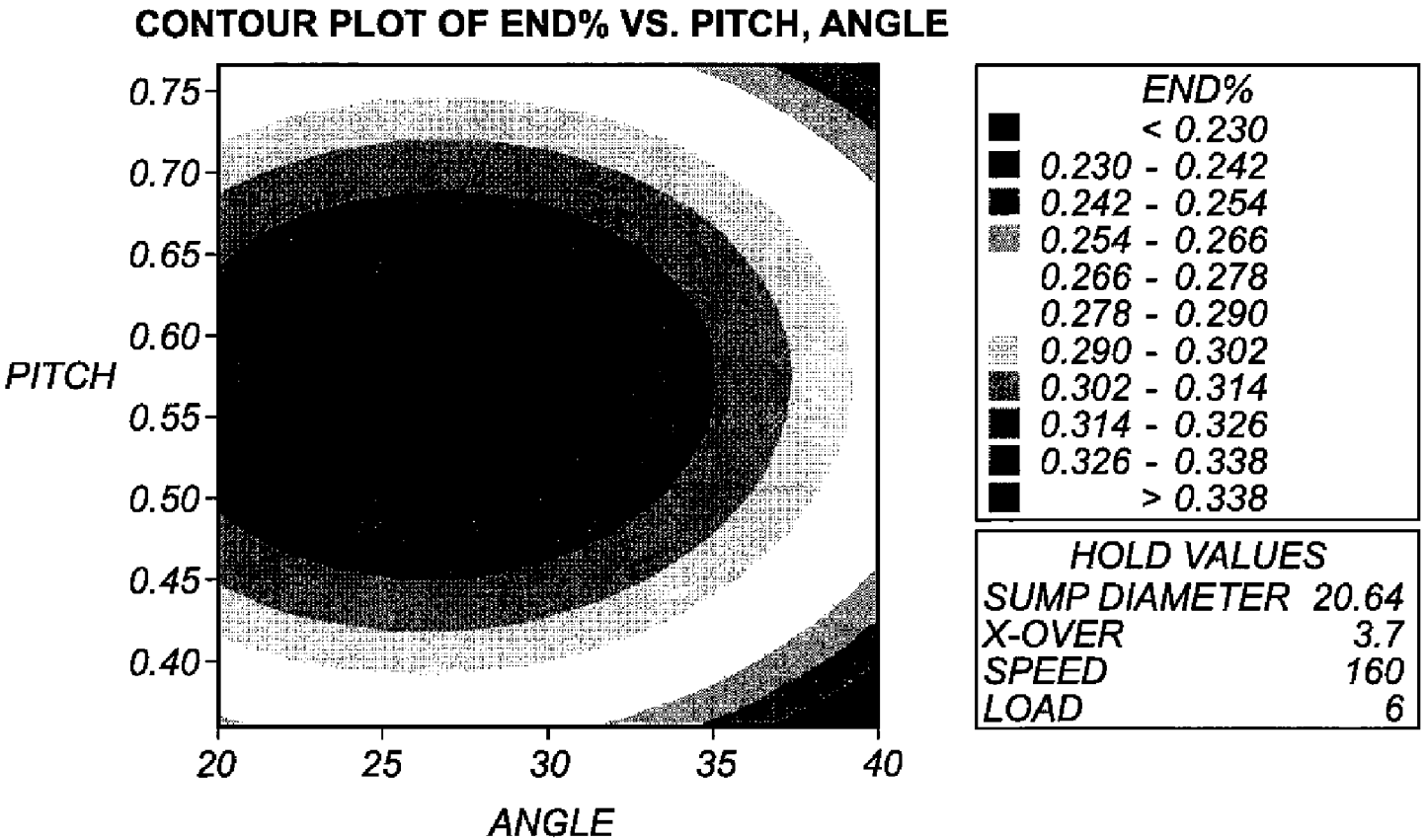
FIG. 12 shows a graphic representation of the present invention.

These factors apply to a single channel auger and were developed specifically under the following conditions including preloading the sump with the specified amount of developer (from the experimental array). The motor was then started, along with a timer. The axial container was observed and the timer was stopped when no more developer was observed exiting the axial portion of sump. The contents of the axial container, the radial container and the residual the left in the sump were measured and reconciled against the original sump load. This relationship is shown graphically in FIG. 12. FIG. 12 shows a Contour plot of End % (% of total sump load pushed out axial end of the sump) vs. Paddle Angle and Paddle Pitch (data for 20.64mm Sump Radius, 3.7X-Over, 160rpm, 6Load Ratio).

From the information in FIG. 12, one can see for this paddle configuration (adjacent paddles @90°), the amount of developer pushed out the end of the channel is maximized when the paddle angle is ≈22°-32°, and the paddle pairs are pitched≈0.500"-0.630". In this manner, the proper circulation (as defined by the % of developer that circulates on the outer walls of a dual auger sump), can be optimized by this invention.

Figure 11:
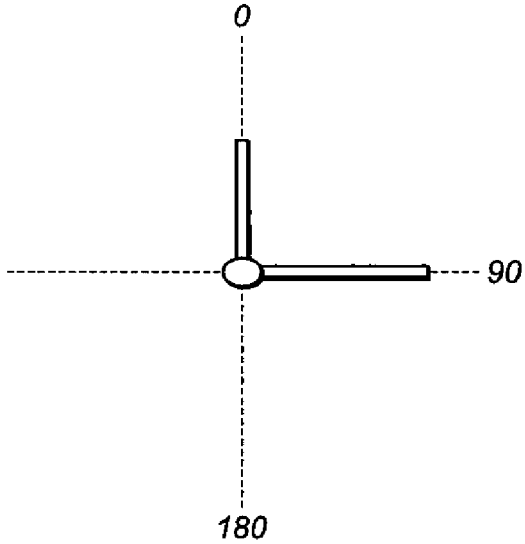
FIG. 11 is a schematic further showing the embodiment of FIG. 10.

Another important element to a well-mixed and efficient transport apparatus with augers as shown in FIG. 9 including the shaft populated with blades (paddles), roughly semi-circular in shape, is the angle that the blades are fixed with respect to the axial centerline of the shaft. The paddle angle and/or orientation have a great influence on the movement and mixing efficiency of developer within the sump. This relationship is optimized by a relationship between the relative amount of developer that is transported parallel to the axis of the auger shaft (Axial) vs. perpendicular to the axis of the auger shaft (Radial). The proportion of developer moved axially and radially to the auger axis can be adjusted by changing the angular orientation of adjacent paddles on the auger shaft between 0° and 180° relative to an orientation of adjacent paddles with the paddles represented by the darker lines in FIG. 11.

The relationship between a series of factors influences the amount of developer that is pushed (Axially to the shaft) and flipped (radially to the shaft). This experiment was structured as a 3 factor Central Composite Design (CCD), face centered, with 2 centerpoint replicates. The strategy was to characterize the flow with a single channel auger (see FIG. 7). The experimental factors consisted of (Table 2) shown below:

TABLE 2

Factors for Single Channel Auger

| Factor | Low Level | Mid Level | High Level |
|---|---|---|---|
| Sump Radius | 17.4625 mm | 20.6375 mm | 25.4 mm |
| Paddle Angle | 20° | 30° | 40° |
| Orientation | 0° | 90° | 180° |

Figure 13:
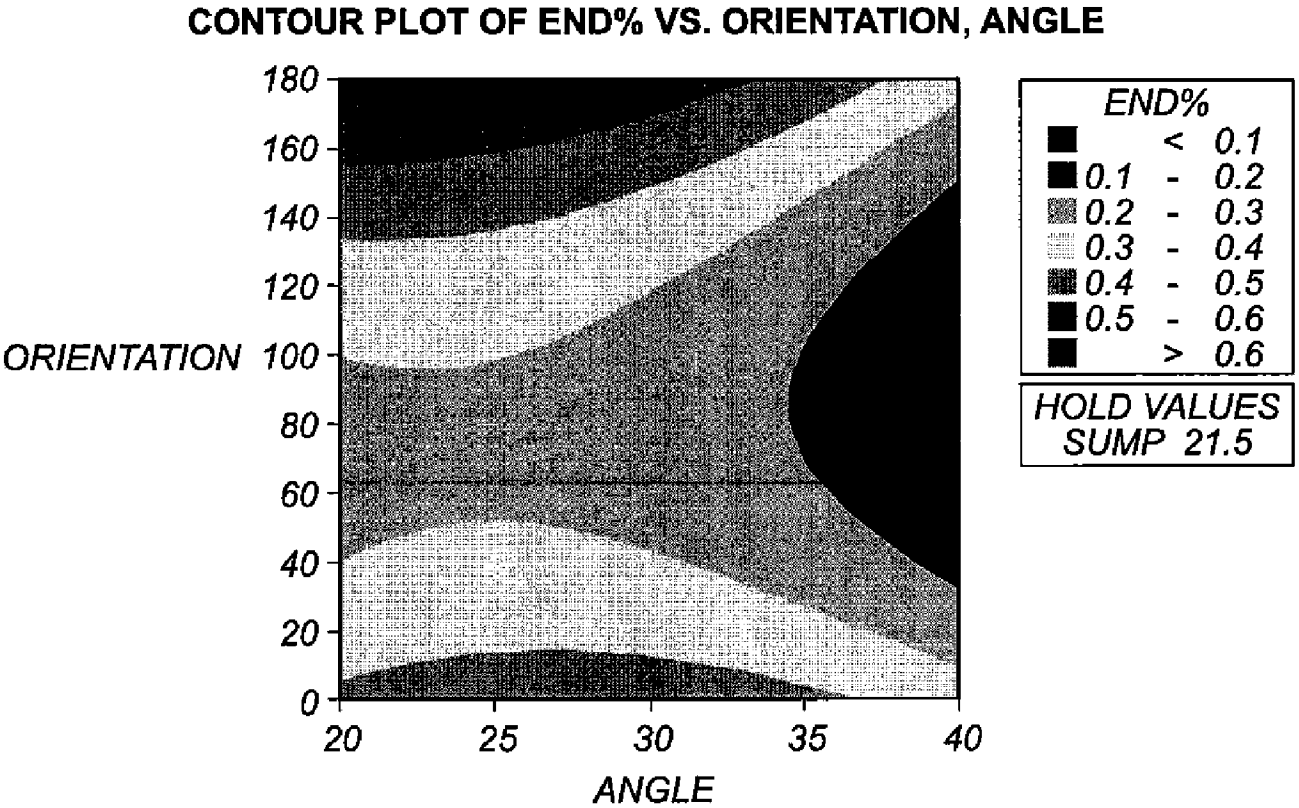
FIG. 13 shows a graphic representation of the present invention.

These factors apply to a single channel auger and were developed specifically under the following conditions including preloading the sump with the specified amount of developer (from the experimental array). The motor was then started, along with a timer. The axial container was observed and the timer was stopped when no more developer was observed exiting the axial portion of the sump. The contents of the axial container, the radial container and the residual left in the sump were measured and reconciled against the original sump load. This relationship is shown below graphically showing a Contour plot of End % (% of total sump load pushed out axial end of the sump) vs. Paddle Angle and Paddle Orientation. From this graph, one can see that the paddle orientation can regulate the amount of developer pushed out the end of the channel, with maximum axial flow exhibited at 180° adjacent paddle orientation and 20° paddle angle. In this manner, the proper circulation (as defined by the % of developer that circulates on the outer walls of a dual auger sump), can be maximized/optimized by this invention as shown in FIG. 13.

Another important element to a well-mixed and efficient transport apparatus with augers as shown in FIG. 9 including the shaft populated with blades (paddles), roughly semi-circular in shape, is the angle that the blades are fixed with respect to the axial centerline of the shaft. The paddle angle and/or orientation have a great influence on the movement and mixing efficiency of developer within the sump. This relationship is optimized by optimizing the relationship between the relative amounts of developer that is transported parallel to the axis of the auger shaft (Axial) vs. perpendicular to the axis of the auger shaft (Radial) in addition to the factors discussed above. Mixing efficiency (as defined by the lowest standard deviation of 'n' Toner Concentration measurements at different areas of the sump) is maximized by minimizing the ratio of the amount of developer that is transported axially along the sump shaft (Push) to the amount moved radially between the auger shafts (Flip) in a dual auger sump configuration. The factors evaluated and optimized to characterize mixing efficiency w.r.t include the following factors that affect mixing efficiency and developer flip %:

| Factor | Description |
|---|---|
| X-Over | Ratio of Sump Radius to Centerwall Height |
| Paddle Orientation | Angular Orientation of Adjacent Paddles |
| Paddle Angle | Angle of the Paddle to Drive Axis of Auger Shaft |
| Auger Speed | Nominal Speed of the Auger Shaft |

These factors apply to a multi-channel auger, in particular a dual channel, auger and were developed specifically under the following conditions including loading the sump with an appropriate amount of developer, and running for some period of time to uniformly distribute the developer load within the sump. Toner was added to raise the toner concentration in the sump by a prescribed amount. The sump was then run additionally, to allow for mixing and transport of the toner-replenished developer. A number of toner concentration measurements were made at various mixing times. Results of the toner concentration after these mixing times formed the basis for the assessment of the mixing efficiency are summarized below in the tables and charts comparing effect of certain paddle configuration parameters on both Flip % and effect on mixing efficiency.

TABLE 1

Chart comparing effect of certain paddle configuration parameters on both Flip % and effect on mixing efficiency.

| Factor | Effect on Developer Flip % | Effect on Mixing Efficiency |
|---|---|---|
| X-Over | As Centerwall Height Becomes Lower, Flip % Increases | As Centerwall Height Becomes Lower, Mixing Efficiency Improves |
| Paddle Orientation | Flip % Maximized at 40° >= Paddle Orientation <= 120°, Minimum Flip % at 180° | 90° Orientation Results in Better Mixing Efficiency than 180° Orientation |
| Paddle Angle | Flip % increases substantially with Paddle Angles > 30° | 40° Paddle Angle Mixing Superior than 20°/30° |

TABLE 1-continued

Chart comparing effect of certain paddle configuration parameters on both Flip % and effect on mixing efficiency.

| Factor | Effect on Developer Flip % | Effect on Mixing Efficiency |
|---|---|---|
| Auger Speed | Flip % increases with increasing Auger Speed | Mixing efficiency improves with increasing Auger Speed |

Figure 14:
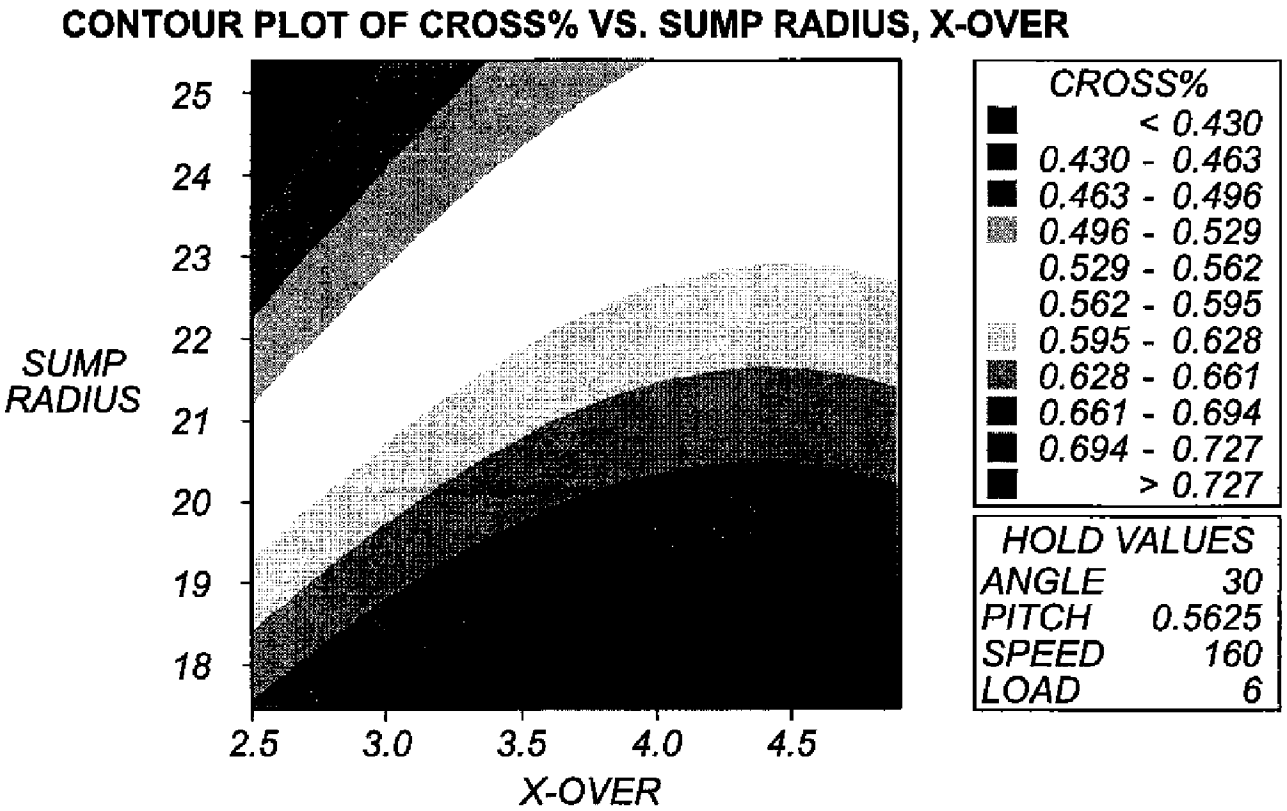
FIG. 14 shows a graphic representation of the present invention.

FIG. 14 is a graphical representation of some of the data gathered showing mixing effect of Centerwall height, Paddle Orientation, Paddle Angle and Auger Speed. (Lower Std. Dev. Equates to better mixing efficiency). FIG. 14 shows a contour of cross % versus sump radius and/or cross over in percentages for an angle of 30 degrees, pitch of 0.5625, speed of 160 and a load of 6.

Figure 15:
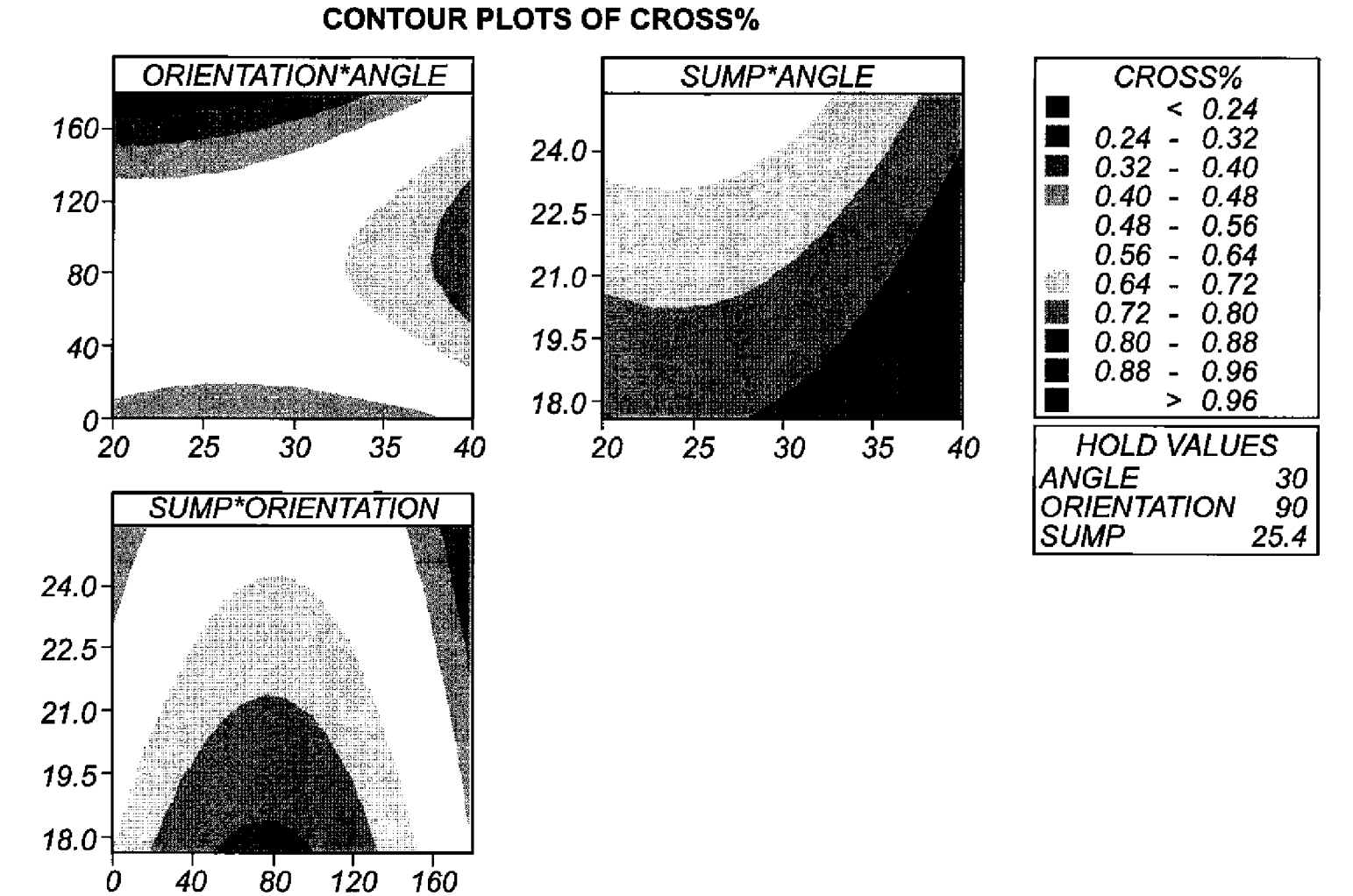
FIG. 15 shows a graphic representation of the present invention.
Figure 16:
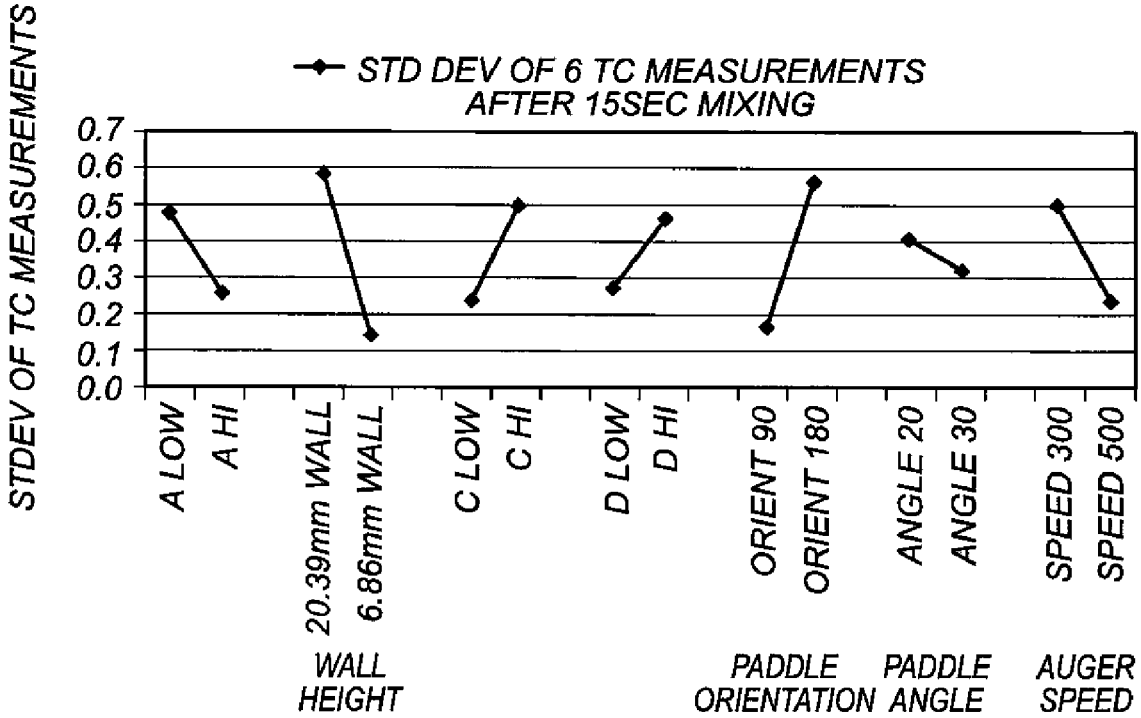
FIG. 16 shows a variety of optimized examples.

FIG. 15 is a graphical representation of some of the date gathered showing data for Contour Plot of Flip % (Cross %) vs. Paddle Orientation (Orientation). Paddle Angle (Angle) and Sump Radius (Sump). The contour plot of Flip % (Cross %) against Sump Radius and X-Over (Centerwall Height). X-Over has inverse relationship to Centerwall Height, thus X-Over 4.5 has shorter Centerwall Height than X-Over 2.5. FIG. 15 shows a contour of cross % for orientation angle, sump angle and sump orientation for an angle of 30 degrees and an orientation 90 degrees.

The above described along with the summarized relationships between the Flip % and the resulting mixing efficiency as well as those shown in FIGS. 12-15 allow optimization of the auger in a development station in a variety of situations. Configurations that flip better result in more intimate contact between the opposing streams of the developer, resulting in faster and more efficient mixing of the replenished toner.

Figure 17:
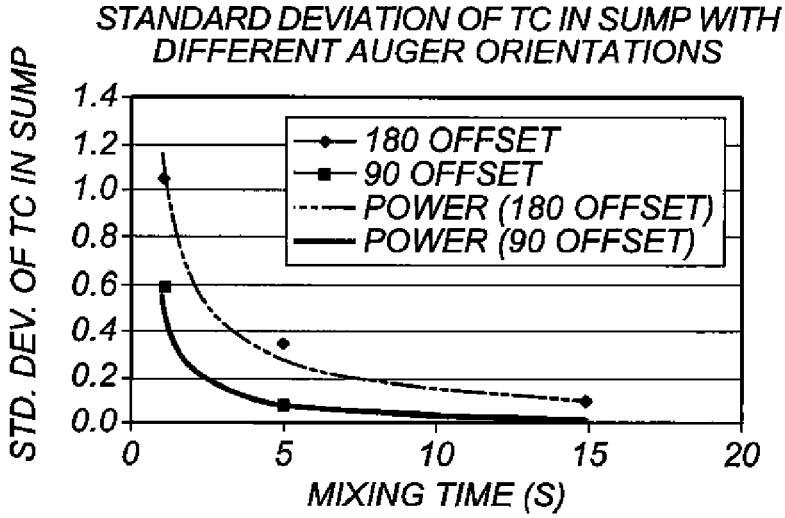
FIG. 17 shows an example for different auger orientations.

An example of one optimized arrangement based on this information includes a full sump with a configuration of 90° Paddle Orientation (40° Paddle Angle) against 180° Paddle Orientation (20° Paddle Angle) (Sump Radius=25.4 mm, X-Over=3.7, Auger Speed=500 rpm). The curves clearly show the preference for the 90° Paddle Orientation (40° Paddle Angle) over the 180° Paddle Orientation (20° Paddle Angle) as shown in FIG. 17.

The invention has been described in detail with particular reference to certain preferred embodiments thereof, but it will be understood that variations and modifications can be effected within the spirit and scope of the invention.

The invention claimed is:

1. An apparatus for transporting powder into a developer station containing at least powder and magnetic carrier comprising:

a. a development station housing divided into a feed apparatus located adjacent to a development roller and a powder conveyance device;

b. the powder conveyance device having a single channel divided into a first mixing space adjacent to a second separate transport space, the second transport space located adjacent to the feed apparatus; the powder conveyance comprising two or more augers each having a shaft; and c. a conveyance controller for controlling the powder conveying device, including the two or more augers, such that the auger preferentially mixes in the first mixing space by minimizing P/F (Push/Flip) and transports in the second transport space as the powder conveying device conveys the powder toward the feed apparatus by maximizing P/F(Push/Flip).

2. The developing apparatus of claim1, further comprises preferentially mixing the powder and magnetic carrier in the first mixing space before it moves into the second transport space.

3. The developing apparatus of claim 1, the conveyance controller further controlling a paddle angle to further control the volume of powder and magnetic carrier moved both axially and radially toward one or more shaft.

4. The developing apparatus of claim 3, conveyance controller further controlling the ratio of a powder volume to a magnetic carrier volume moved both axially and radially toward one or more shaft.

5. The developing apparatus of claim 3, conveyance controller further controlling the ratio of the powder volume and magnetic carrier moved axially toward one or more shaft to the powder volume and magnetic carrier moved radially toward one or more shaft.

6. The developing apparatus of claim 3, wherein the paddle angle ranges from 20-40 degrees.

7. The developing apparatus of claim 1,the conveyance controller further controlling a blade paddle orientation to further control the volume of powder and magnetic carrier moved both axially and radially toward one or more shaft.

8. The developing apparatus of claim 7, conveyance controller further controlling the ratio of a powder volume to a magnetic carrier volume moved both axially and radially toward one or more shaft.

9. The developing apparatus of claim 7, conveyance controller further controlling the ratio of the powder volume and magnetic carrier moved axially toward one or more shaft to the powder and magnetic carrier volume moved radially toward one or more shaft.

10. The developing apparatus of claim 7, wherein the blade paddle orientation ranges from 90 to 180 degrees.

11. The developing apparatus of claim 1, the conveyance controller further controlling a direction of the rotation of the blade to further control the volume of powder and magnetic carrier moved both axially and radially toward one or more shaft.

12. The developing apparatus of claim 1, the conveyance controller further controlling a direction of the rotation of the blade to further control the volume of powder and magnetic carrier that moves up wall and down wall to preferentially mix or push the powder and magnetic carrier volume.

13. The developing apparatus of claim 1, the conveyance controller further controlling a blade wall distance spacing Z to further control the volume of powder and magnetic carrier that is preferentially mixed or pushed.

14. The developing apparatus of claim 1, the conveyance controller further controlling a conveyance-housing diameter to further control the volume of powder and magnetic carrier that is preferentially mixed or pushed.

15. The developing apparatus of claim 14,the conveyance controller further controlling the conveyance-housing diameter to between 10 and 75mm.

16. The developing apparatus of claim 14, the conveyance controller further controlling the conveyance-housing diameter to greater than 10 mm.

17. A method of conveying powder to a development roller, the method comprising:

a. moving the powder between a first mixing space to a second transport space located adjacent to the development roller using a powder conveying device comprising two or more augers;

b. controlling the powder conveying device having a single channel such that the powder is conveyed toward the imaging device of a print engine through the second separate transport space, and c. controlling the two or more augers such that the auger preferentially mixes in the first mixing space by minimizing P/F (Push/Flip) and transports in the second transport space by maximizing P/F (Push/Flip) simply using auger rotation.

18. The method of claim 17, the method further comprising controlling the paddle angle range from 20-40 degrees.

19. The method of claim 17, the method further comprising controlling a blade (paddle) orientation from 90 to 180 degrees.

20. The method of claim 17, the method further comprising controlling the paddle angle range from 20-40 degrees and a blade (paddle) orientation from 90 to 180 degrees.

21. The method of claim 17, the method further comprising controlling a direction of the rotation of the blade to further control the volume of powder and magnetic carrier that moves up wall and down.

22. The method of claim 17, the method further comprising controlling a blade wall distance (spacing) to further control the volume of powder and magnetic carrier that is preferentially mixed or pushed.

23. The method of claim 17, the method further comprising controlling a conveyance controller further controlling a conveyance housing diameter to further control the volume of powder and magnetic carrier that is preferentially mixed or pushed.

24. An apparatus for transporting powder into a developer station containing at least powder and magnetic carrier comprising:

a. a development station housing divided into a feed apparatus located adjacent to a development roller and a powder conveyance device;

b. the powder conveyance device divided into a first mixing space adjacent to a second separate transport space, the second transport space located adjacent to the feed apparatus; the powder conveyance comprising two or more augers each having a shaft; and c. a conveyance controller for controlling the powder conveying device, including the two or more augers, such that the auger preferentially mixes in the first mixing space and transports in the second transport space as the powder conveying device conveys the powder toward the feed apparatus, the conveyance controller further controlling a blade wall distance spacing Z to further control the volume of powder and magnetic carrier that is preferentially mixed or pushed.

25. A method of conveying powder to a development roller, the method comprising:

a. moving the powder between a first mixing space to a second transport space located adjacent to the development roller using a powder conveying device comprising two or more augers;

b. controlling the powder conveying device such that the powder is conveyed toward the imaging device of a print engine through the second separate transport space, and c. controlling the two or more augers such that the auger preferentially mixes in the first mixing space and transports in the second transport space simply using auger rotation and further controlling a blade wall distance spacing to further control the volume of powder and magnetic carrier that is preferentially mixed or pushed.

26. The method of claim 25 further comprising controlling a conveyance controller further controlling a conveyance-housing diameter to further control the volume of powder and magnetic carrier that is preferentially mixed or pushed.

27. An apparatus for transporting powder into a developer station containing at least powder and magnetic carrier comprising:

a. a development station housing divided into a feed apparatus located adjacent to a development roller and a powder conveyance device;

b. the powder conveyance device divided into a first mixing space adjacent to a second separate transport space, the second transport space located adjacent to the feed apparatus; the powder conveyance comprising two or more augers each having a shaft; and c. a conveyance controller for controlling the powder conveying device, including the two or more augers, such that the auger preferentially mixes in the first mixing space and transports in the second transport space as the powder conveying device conveys the powder toward the feed apparatus , the conveyance controller further controlling a conveyance housing diameter to further control the volume of powder and magnetic carrier that is preferentially mixed or pushed.

28. The developing apparatus of claim 27, the conveyance controller further controlling the conveyance-housing diameter to between 10 and 75 mm.

29. The developing apparatus of claim 27, the conveyance controller further controlling the conveyance-housing diameter to greater than 10 mm.

* * * * *